US009671077B2

(12) United States Patent
Schimon et al.

(10) Patent No.: US 9,671,077 B2
(45) Date of Patent: Jun. 6, 2017

(54) LED ILLUMINATION UNIT HAVING MASK AND REFLECTOR

(71) Applicant: Hella KGaA Hueck & Co., Lippstadt (DE)

(72) Inventors: Jaroslaw Schimon, Bielefeld (DE); Martin Seipel, Bad Wünnenberg (DE)

(73) Assignee: Hella KGaA Hueck & Co., Lippstadt (DE)

( * ) Notice: Subject to any disclaimer, the term of this patent is extended or adjusted under 35 U.S.C. 154(b) by 391 days.

(21) Appl. No.: 14/046,647

(22) Filed: Oct. 4, 2013

(65) Prior Publication Data

US 2014/0098554 A1 Apr. 10, 2014

(30) Foreign Application Priority Data

Oct. 5, 2012 (DE) ..... 10 2012 109 491

(51) Int. Cl.
*F21S 8/12* (2006.01)
*F21V 11/10* (2006.01)
*F21S 8/10* (2006.01)

(52) U.S. Cl.
CPC ..... *F21S 48/00* (2013.01); *F21S 48/1104* (2013.01); *F21S 48/1159* (2013.01); *F21S 48/145* (2013.01); *F21S 48/211* (2013.01); *F21S 48/215* (2013.01); *F21S 48/328* (2013.01)

(58) Field of Classification Search
CPC ..... F21S 8/12; F21W 2101/10; F21V 7/0066; F21V 11/08; F21V 11/12; F21V 13/10; F21V 11/16; F21V 11/10
See application file for complete search history.

(56) References Cited

U.S. PATENT DOCUMENTS 6,575,608 B2 * 6/2003 Oyama ..... F21S 48/1388 362/297
7,207,705 B2 * 4/2007 Ishida ..... F21S 48/1159 362/298
7,306,352 B2 * 12/2007 Sokolov ..... G02B 5/12 362/297
7,316,492 B2 * 1/2008 Yamamura ..... F21S 48/1778 362/512
7,364,332 B2 * 4/2008 Komatsu ..... F21S 48/1186 362/509
7,712,935 B2 * 5/2010 Tsukamoto ..... F21S 48/1159 362/299
7,784,977 B2 * 8/2010 Moolman ..... F21V 7/0008 362/105
7,972,046 B2 * 7/2011 Iwasaki ..... F21S 48/1159 362/517

(Continued)

FOREIGN PATENT DOCUMENTS

DE 10258536 A1 7/2004
DE 102008034376 A1 1/2010

(Continued)

*Primary Examiner* — Ismael Negron
(74) *Attorney, Agent, or Firm* — Husch Blackwell LLP

(57) ABSTRACT

An illumination unit for a motor vehicle includes at least one LED, a reflector defining a main light exit aperture, and a shading element with an opening provided between the reflector and the LED, with the light from the LED leaving through the opening and the shading element limiting the emission area.

8 Claims, 2 Drawing Sheets

(56) References Cited

U.S. PATENT DOCUMENTS

| | | | | |
|---|---|---|---|---|
| 7,988,336 | B1 * | 8/2011 | Harbers | F21K 9/00 257/712 |
| 8,220,970 | B1 * | 7/2012 | Khazi | F21V 29/004 362/294 |
| 8,500,299 | B2 * | 8/2013 | Speidel | F21V 11/00 362/235 |
| 8,523,389 | B2 * | 9/2013 | Holten | F21V 7/0008 362/223 |
| 8,622,597 | B2 * | 1/2014 | Tseng | F21S 48/1159 362/515 |
| 8,632,233 | B2 * | 1/2014 | Kawamura | F21S 48/1145 362/517 |
| 8,801,251 | B2 * | 8/2014 | Ohmi | F21S 48/1104 315/82 |
| 9,010,977 | B2 * | 4/2015 | Harbers | F21K 9/00 362/294 |
| 2008/0013333 | A1 | 1/2008 | Koizumi et al. | |
| 2008/0225540 | A1 * | 9/2008 | Tsukamoto | F21S 48/1159 362/514 |
| 2011/0205735 | A1 * | 8/2011 | Suzuki | F21V 7/0008 362/235 |
| 2011/0211361 | A1 * | 9/2011 | Kawamura | F21S 48/1145 362/516 |
| 2012/0236563 | A1 * | 9/2012 | Breidenassel | F21V 17/12 362/249.02 |

FOREIGN PATENT DOCUMENTS

| | | | |
|---|---|---|---|
| DE | 102010018723 | A1 | 11/2011 |
| DE | 102011080489 | A1 | 8/2012 |
| EP | 2340967 | A1 | 7/2011 |

* cited by examiner

LED ILLUMINATION UNIT HAVING MASK AND REFLECTOR

CROSS REFERENCE

This application claims priority to German Patent Application No. 10 2012 109491.8, filed Oct. 5, 2012.

TECHNICAL FIELD OF THE INVENTION

The invention relates to an illumination unit for a motor vehicle.

BACKGROUND OF THE INVENTION

From the publication DE 102 60 383 B4, an illumination unit for a motor vehicle with a light source is known, wherein the light source can be embodied as an LED, and has an emission area with emittable light. Herein, the emittable light can, on one hand leave from a main light exit aperture and on the other hand from a lateral light exit aperture. Herein, the emittable light of the LED is directed onto the main light exit aperture by means of a cylinder without being reflected. The cylinder has an opening serving a lateral light exit aperture. Part of the emittable light of the LED can leave here. The fact that the emission area of the LED is emitted directly onto the main light exit aperture, however, has proven to be disadvantageous, as a high light value is generated.

SUMMARY OF THE INVENTION

It is the task of the present invention to provide an illumination unit for a motor vehicle, and in particular a motor vehicle illumination unit, wherein the illumination unit has a simple and reliable design, and in particular, that the light value of the directly emitted light of the LED is controllable.

To solve this task, an illumination unit with the characteristics of claim 1 is proposed, and in particular with the characteristics of the characterizing portion. Preferred embodiments are outlined in the dependent claims. Herein, the characteristics mentioned in the claims and in the description can be essential for the invention each on their own or in combination. Characteristics and details described in connection with the procedure according to the invention, do therefore obviously also apply in connection with the device according to the invention and vice versa. Herein the characteristics mentioned in the claims and in the description can be essential for the invention each on their own or in any combination.

The invention discloses an illumination unit for a motor vehicle with at least one LED and a main light exit aperture, wherein the LED comprises an emission area with emittable light, which can be redirected onto the light exit aperture by means of a reflector. According to the invention, it is provided that a shading element with an opening is arranged between the reflector and the LED, wherein the emittable light can leave the opening. Herein, the shading element limits the emission area. On one hand, the emitted light of the LED can be limited by the shading element so that only a defined part of the emission area of the LED is emitted onto the reflector. On the other hand, the directly emitted light of the LED can be limited by the shading element so that only light that has been reflected by the reflector is projected onto the main light exit aperture. Direct light emission of the LED onto the main light exit aperture can therefore be excluded, thus effectively avoiding stray light but also dazzling. By this means, a direct visibility of the LED through the main light exit aperture can be avoided by means of the shading element. Herewith, new designs of illumination units for motor vehicles could also be created, which can lead to a harmonization of the appearance in reflector type headlamps in a motor vehicle with different surfaces and color designs. In addition, the use of standard LED types is possible, which can reduce the manufacturing costs of the illumination unit. Furthermore, the shading element serves as a protection for components in the illumination unit, as the emittable light of the LED is now directly directed onto the reflector by the shading element.

It is particularly advantageous, that the opening is embodied in a circular, rectangular or in a freeform contour. By this means, the emission area of the LED can be adapted to match the geometry of the reflector. Herein, various cross-sections of the opening can be employed, wherein a very small opening forms the emission area of the LED to be punctiform. The larger the cross-section of the opening is selected, the higher is the light intensity, with which the reflector is irradiated. Correspondingly it is conceivable, that the shading element has several openings by means of which the emission area is divided into various areas. With these, different areas of the reflector surfaces can be irradiated in a directed manner with the emittable light of the LED. Accordingly, it is conceivable, that several LEDs are employed, wherein each LED or also a multitude of LEDs is assigned to an opening.

Furthermore, it is advantageous, that an assembly body is provided, on which the LEDs are arranged. Herein, the assembly body can have a surface on which the LEDs are arranged. The LEDs can here be embodied as an LED module, wherein the LED module can have a carrier comprising amongst others the energy supply lines. The illumination unit comprises main elements, such as e.g. the reflector, the assembly body, the LED, the shading element and a surrounding component part. Herein, the LED can be attached to the assembly body by means of a gluing process. The surrounding component part protects the LED module and the assembly body from unintentional application of a force. In addition, the assembly body, the shading element with its opening and the LED module are covered by the surrounding component part. The observer of the illumination unit will therefore only be able to view the reflector, the shading element with its opening and the surrounding component part. A direct view through the main light exit aperture onto the LED can be prevented by the shading element. In so far, a direct exposure of the eye of the observer to the light of the LED can be avoided, no matter from which angle the observer perceives the illumination unit.

It is advantageous, that the assembly body is embodies as heatsink. The operation of LEDs resp. LED modules causes heat development which may be far in excess of 100° C. To protect the LED resp. the LED module from destruction by heat, the LED resp. the LED module can be attached to the heatsink by means of a gluing, welding or screw-fastening process. In case of a gluing process of the LED module, a heat conducting adhesive can be applied. The carrier on which the LED can be arranged, can be made from a heat conducting material. By this means, a sufficient heat transfer from the LED over the carrier onto the heatsink is ensured. Herein it is advantageous, that the assembly body comprises at least one cooling fin. By this means the generated heat caused by the operation of the LED can be effectively dissipated into the environment.

It is advantageous that the shading element has at least a first shading area and a second shading area, wherein the first shading area is arranged offset relative to the second shading area. Herein the first shading area can comprise holding elements by means of which the shading element can be arranged in a form- and/or force-locking manner. Advantageously, snap-fastening elements could be employed here, so that the shading element can be reversibly fastened to the assembly body. It is also conceivable, that the first shading area of the shading element is arranged to the assembly body by means of a gluing process. The first shading area and the second shading area can herein be integrally embodied as a shading element. The shading element can be embodied in a hat- or a saucer-shape. By means of the offset of the second shading area relative to the first shading area, the distance to the LED can be increased. This has the advantage, that the second shading area is protected from the head development of the LED. The second shading area advantageously has the opening through which the emittable light of the LED can leave.

Furthermore, it is advantageous that the shading element has a surface, wherein the surface of the shading element is executed corrugated and/or fluted. A corrugated or fluted execution of the shading element allows a dispersion of the light. By this means, a direct reflection of the light by the surface of the shading element through the main light exit aperture is avoided. The surface can also have a pillow-shaped (pulvinated) design to allow a dispersion of the light falling onto the surface of the shading element. It is also conceivable, that the surface of the shading element is roughened or grained. By this means, too, the effect of the dispersion is effectively achieved.

It is advantageous, that the surface of the shading element has a glossy surface. A glossy surface can reflect the light being reflected by the reflector on the surface purposefully and in a defined manner through the main light exit aperture. By this means, also a purposefully defined dispersion of the light leaving through the main light exit aperture can be achieved, therefore allowing the compliance with the required glare values specified by a legislature. Herein, the surface can be metallic, which in turn may lead to a better heat dissipation of the heat occurring due to the LED. However, glossy surfaces can also be achieved by means of a glossy plastic coating.

Furthermore, it is advantageous that the shading element is made from metal or plastic material. An execution of the shading element in metal increases the stability of the entire illumination unit. In addition the occurring heat inside the illumination unit is more easily dissipated. As the illumination unit as a whole can be made from plastic material, the use of a plastic material for the shading element has the advantage that in an injection molding process, the shading element can be produced with the surrounding component parts. Accordingly, a monolithic execution of the shading element with the surrounding component parts of the illumination unit is conceivable.

Furthermore, it is advantageous, that the shading element has a lower side, which is executed in a specific color, and in particular in the color white. The white color offers the technical advantage, that the absorption of the thermal radiation of the LED is much less than if the shading element has a black lower side. It is also conceivable, that the lower side is executed in a different color, e.g. red, wherein the irradiation of the lower side of the shading element with the emittable light of the LED shows the opening of the shading element in a red shade during operation of the illumination unit. The red color can be perceived as a signal color by the observer, so that his attention is drawn to the fact that increased temperatures must be expected while he is working on the illumination unit during operation of the LED.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
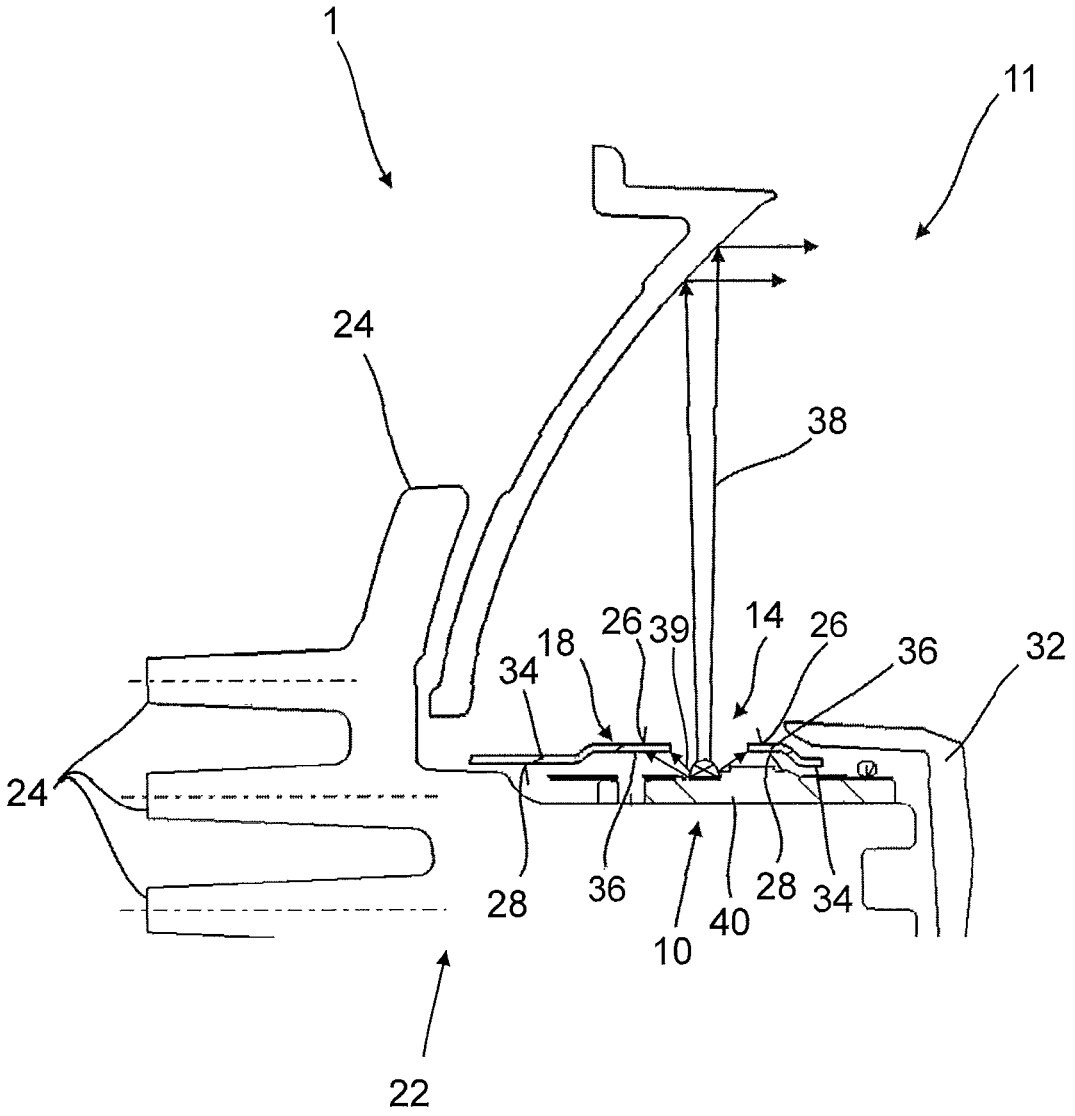
FIG. 1 shows a schematic section through an illumination unit.

FIG. 1 represents a schematic section through an illumination unit 1. Herein, an LED 10 emits visible light 38 essentially orthogonally onto a reflector 12. The emitted light 38 is herein deflected by the reflector 12 and emitted through a main light exit aperture 11. The emission area of the LED 10 is herein limited by the shading element 18, thus achieving an essentially orthogonal emission 38. Essentially non-orthogonal emission 39 is limited by the shading element 18. To this end, the shading element 18 has an opening 14 through which the emitted light of the LED 10 can leave. The size of this opening 14 can be variable. Herein, the shading element 18 has a first area 34 and a second area 36. The first area 34 is arranged offset in height relative to the second area 36. By this means, the second area 36 of the shading element 18 is arranged at a larger distance from the LED 10. A deformation of the shading element 18 due to the heat development of the LED 10, particularly in an embodiment made from plastic material, can be effectively avoided. The first area 34 can herein have holding elements, which with the shading element 18 can be arranged on an assembly carrier 22. A gluing- or welding process may also be applied to arrange the shading element 18 on the assembly carrier 22. Herein, the LED 10 is arranged on a module 38 in which the strip conductors for the energy supply of the LED can be arranged. The module 38 can be made from a material with high thermal conductivity. By this means, the transmission of the heat developed by the LED 10 by the module 38 to the assembly carrier 22 is possible; therefore it is particularly advantageous if the assembly carrier 22 is embodied as a heatsink 22. Herein, the assembly carrier 22 can comprise cooling fins 24 to dissipate the heat to the ambient air. A surrounding component part 32 is arranged around the shading element 18 of the LED module 38 of the LED 10 and the assembly carrier 22 to protect these component parts. The surrounding component part 32 extends to the opening 14, so that an observer looking into the main light exit aperture 11, essentially only perceives the surrounding component part 32, the shading element 18 and the reflector 12. Herein, the surface 26 of the shading element 18 can be executed glossy or matte. A matte execution of the surface 26 allows a dispersion of the light being reflected from the reflector 12 and falling onto the surface 26. The lower side 28 can be executed in the color white, so that the shading element 18 experiences less heat absorption than with an execution in the color black.

Figure 2:
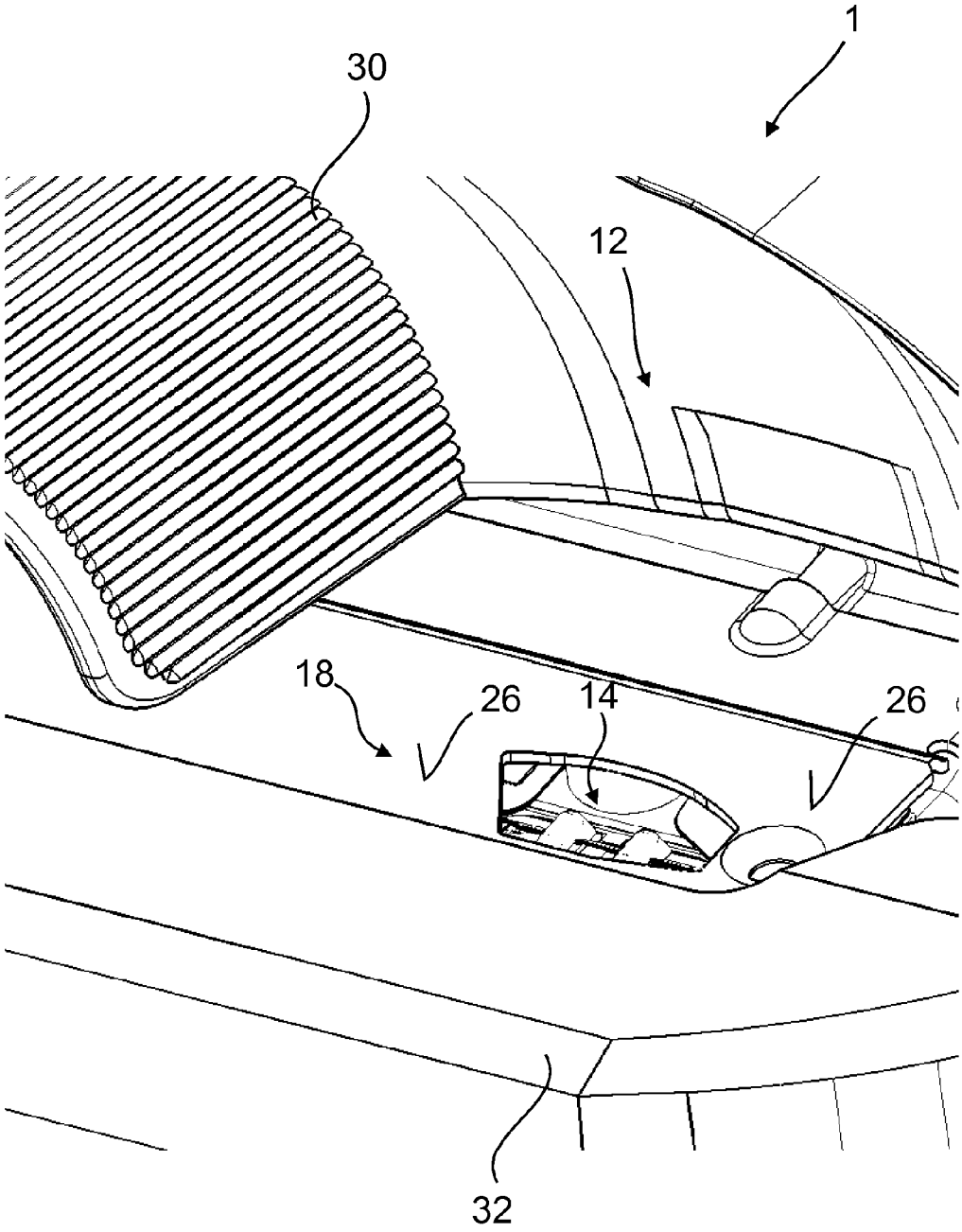
FIG. 2 shows a schematic view of an illumination unit.

In FIG. 2, an illumination unit 1 is represented schematically. Herein, an LED 10 can emit light 38 through an opening 14 of a shading element 18. The opening 14 of the shading element 18 comprises herein a freeform contour. Various contours can be applied, such as e.g. a circular, triangular, rectangular or also star-shaped form of the opening 14. Only the LED-module 40 can be noticed through the opening 14 of the shading element 18. The LED 10 is not visible, no matter from which viewing angle the observer looks into the illumination unit. The shading element 18 does herein have a surface 26 which can be executed in metal. By this means, reflections can leave the main light exit aperture 11 in a directed manner. The surface 26 can also be executed matte to achieve a dispersion of the emitted light of the LED 10, though. The surface 26 can also be executed corrugated or fluted, which would also lead to a dispersion of the light. A further component part 30, the surface of which is corrugated, serves the further dispersion of the emitted light of the LED 10. A surrounding component part 32 covers a part of the shading element 18 and of the LED-module 10, so that only the further component part 30, the reflector 12, the shading element 18 with its opening 14 and the surrounding component part 32 are visible through the main light exit aperture 11.

| List of Reference Signs | |
|---|---|
| 1 | Illumination unit |
| 10 | LED |
| 11 | Main light exit aperture |
| 12 | Reflector |
| 14 | Opening |
| 18 | Shading element |
| 22 | Assembly carrier, heatsink |
| 24 | Cooling fins |
| 26 | Surface |

-continued

| List of Reference Signs | |
|---|---|
| 28 | Lower side |
| 30 | Component part |
| 32 | Surrounding component part |
| 34 | First area |
| 36 | Second area |
| 38 | Emitted light |
| 39 | Non-Orthogonal Emitted Light |
| 40 | LED Module |

The invention claimed is:

1. An illumination unit for a motor vehicle, comprising:

at least one LED having a light emission area, a main light exit aperture, a reflector configured for deflecting light by the LED towards the main light exit aperture, and a shading element formed as a sheet having a through-hole therethrough, the shading element positioned between the reflector and the LED to allow only substantially essentially orthogonally emitted light from the LED through the through-hole in the sheet toward the reflector, wherein a longitudinal axis of at least a portion of the sheet extends perpendicularly with respect to light emitted essentially orthogonally by the LED, and wherein essentially non-orthogonally emitted light encounters the portion of the sheet that extends perpendicularly with respect to the essentially orthogonally emitted light.

2. The illumination unit according to claim 1, wherein the shading element comprises at least a first shading area and a second shading area, wherein the first shading area is arranged offset relative to the second shading area.

3. The illumination unit according to claim 1, wherein the shading element has a surface, wherein the surface of the shading element has a glossy surface.

4. The illumination unit according to claim 1, wherein the shading element is made from metal or plastic material.

5. The illumination unit according to claim 1, wherein the shading element has a lower side being in the color white.

6. The illumination unit according to claim 1, further comprising an assembly body on which the LED is arranged.

7. The illumination unit according to claim 6, wherein the assembly body is a heatsink.

8. The illumination unit according to claim 6, wherein the assembly body comprises at least one cooling fin.

* * * * *